US006530433B2

(12) United States Patent
Smith et al.

(10) Patent No.: US 6,530,433 B2
(45) Date of Patent: Mar. 11, 2003

(54) WELLHEAD WITH ESP CABLE PACK-OFF FOR LOW PRESSURE APPLICATIONS

(75) Inventors: Leslie Dean Smith, Fritch, TX (US); Charles Robert Milton, Fritch, TX (US); Timothy Lewis Clifton, Borger, TX (US); Robert Daniel Winegar, Borger, TX (US)

(73) Assignee: Robbins & Myers Energy Systems, L.P., Houston, TX (US)

( * ) Notice: Subject to any disclaimer, the term of this patent is extended or adjusted under 35 U.S.C. 154(b) by 0 days.

(21) Appl. No.: 09/733,163

(22) Filed: Dec. 8, 2000

(65) Prior Publication Data

US 2002/0070030 A1 Jun. 13, 2002

Related U.S. Application Data

(60) Provisional application No. 60/169,738, filed on Dec. 8, 1999.

(51) Int. Cl.[7] ..... E21B 33/035; E21B 33/038; E21B 33/047

(52) U.S. Cl. ..... 166/387; 166/368; 166/65.1; 166/97.5; 166/89.2

(58) Field of Search ..... 166/65.1, 368, 166/387, 75.11, 95.1, 75.13, 97.5, 242.2, 89.2

(56) References Cited

U.S. PATENT DOCUMENTS 3,437,149 A * 4/1969 Cugini et al. ..... 166/379
4,154,302 A * 5/1979 Cugini ..... 166/378
4,260,022 A * 4/1981 Van Bilderbeek ..... 166/339
4,289,199 A * 9/1981 McGee ..... 166/65.1
4,600,054 A * 7/1986 Miller et al. ..... 166/65.1
4,627,489 A * 12/1986 Reed ..... 166/65.1
4,708,201 A * 11/1987 Reed ..... 166/65.1
5,148,864 A * 9/1992 Willis et al. ..... 166/65.1
5,795,169 A * 8/1998 Reed ..... 166/65.1
6,202,743 B1 * 3/2001 Moore ..... 166/65.1

FOREIGN PATENT DOCUMENTS

CA 2327987 A1 * 6/2001 ..... E21B/33/04
WO WO 97/39506 * 10/1997 ..... E21B/33/02

* cited by examiner

*Primary Examiner*—William Neuder
*Assistant Examiner*—Jennifer H Gay
(74) *Attorney, Agent, or Firm*—Browning Bushman, P.C.

(57) ABSTRACT

A wellhead 10 for use with subterranean wells includes an improved tubing hanger 16 including an improved electric power cable pack-off port 20 that permits positioning an electric submersible pump ("ESP") power cable 40 through the port 20 in the tubing hanger. The improved wellhead permits installation of packing 34 and compression rings 30, 32 within the power cable port 20 to create a vapor-tight pressure seal around the outer cable jacket 41. The seal may be rated at pressures of at least 750 psia. The wellhead 10 comprises a wellhead body 12 for supporting a tubing hanger 16, the tubing hanger including a tubing port 22 and a power cable port 20 for passing electrical power from an electrical power source 72 through the power cable port to the electric motor M. The wellhead 10 also includes a cable seal 34 within the power cable port, a lower packing seat 66, and a packing gland 24 selectively moveable with respect to the seat for compressing the cable seal 34 to form a pneumatic seal.

64 Claims, 5 Drawing Sheets

WELLHEAD WITH ESP CABLE PACK-OFF FOR LOW PRESSURE APPLICATIONS

RELATED CASE

The present application claims priority from U.S. Ser. No. 60/169,738, filed Dec. 8, 1999.

FIELD OF THE INVENTION

A wellhead for use with subterranean wells includes an improved tubing hanger including an improved electric power cable pack-off port that permits positioning an electric submergible pump ("ESP") power cable through the port in the tubing hanger. The improved wellhead permits installation of packing and compression rings within the power cable port to create a vapor-tight pressure seal around the outer cable jacket. The seal may be rated at pressures of at least 750 psia.

BACKGROUND OF THE INVENTION

A wellhead is commonly used for suspending production tubing and casing inside the well-bore of an oil or gas well. Typically, a tubing hanger including female threads may be attached to the uppermost joint of production tubing to support the production tubing string and provide a seal between the tubing, the casing annulus and the atmosphere external to the well. The tubing hanger may engage a substantially complimentary receptacle port in the upper portion of the wellhead body. In a naturally flowing gas well, the hanger may include a tubing port, having a substantially coaxial lower portion and upper portion, both of which may be threaded, wherein the lower portion of the port may engage the uppermost threads of the suspended production tubing string and the upper portion of the port may engage a surface production line, valve or other production conduit, allowing gas or well fluids to pass through the well-head and into a pipeline or vessel. The wellhead body may also have two side ports to permit venting of gas vapors from within the annulus between the production tubing and production casing strings to a pipeline or vessel.

Another type of gas well may produce commercial quantities of gas only when an undesirable buildup of water is pumped out of the well-bore so as to reduce back-pressure on the producing formation. Shallow geologic coal bearing formations may contain a substantial supply of methane gas under relatively low reservoir pressure. This gas may have been considered an undesirable by-product, when compared to the value of the coal. If the equipment costs to complete wells drilled into these formations can be kept relatively low, as compared to a high-pressure gas or oil well, then this "coal-bed methane gas" may become a commercially viable natural resource. Unfortunately, water is also frequently present and the down-hole reservoir gas pressure may be so low that gas may be trapped in the formation due to the hydrostatic head of the water. In most coal-bed methane wells, this hydrostatic head may be relieved by pumping the water out of the well-bore by one of several types of artificial lift.

A popular method of pumping water from this type of gas well utilizes an electrical submersible pump and integral electric motor, commonly referred to collectively as an ESP, suspended near the bottom of the well-bore by the production tubing which may be hung from the tubing head or tubing hanger. The water may be pumped through the production port in the tubing hanger and gas may be produced under natural reservoir pressure, up the tubing-casing annulus and out the side ports of the wellhead body. This method of pumping may also require that an ESP power cable be connected between the electric motor of the down-hole ESP and an electrical control panel on the surface. Ideally, in terms of simplicity and cost, in a low-pressure application, a continuous power cable is installed between the control panel and the down-hole pump or ESP. The wellhead should also permit the cable to pass through the top of the wellhead and effect a vapor tight seal so as to prevent valuable gas from being vented to the atmosphere in order to prevent waste of natural resources and to prevent a fire or explosion hazard around the wellhead.

The prior art fails to disclose a reliable and economical method for allowing a continuous ESP power cable to be positioned between a control panel and an ESP. A cost-effective system is desired to create a mechanically effective pneumatic seal at the wellhead. FIGS. 1 and 2 illustrate common prior art wellhead assemblies. The FIG. 1 wellhead may be commonly used on low and high-pressure oil and gas wells equipped for ESP pumping. The wellhead installation illustrated in FIG. 2 may be used on relatively higher-pressure oil and gas wells. Due to their complexity and cost, these type of wellheads may not be desirable for economically marginal low pressure gas or oil wells. In addition, mechanically fabricating and installing all of the components as illustrated in FIG. 1 may be rather difficult. The sealing effectiveness may also be problematic, particularly if all of the eccentric ports or penetrations do not perfectly align with respect to one another.

The wellhead assembly illustrated in FIG. 1 may typically be used in applications for annulus surface pressure ratings of up to 1500 psia. The ESP power cable may pass through the tubing hanger component of the wellhead as a continuous cable from the control panel through the well-head to the ESP motor. A second port or penetration may typically be provided in the metal and rubber packing plates of the tubing hanger, parallel to the threaded port suspending the production tubing. In addition, one or two additional ports may be provided in the tubing hanger to permit passage of capillary tubes to permit injection of well treatment chemicals and/or monitoring of surface pressure in the well annulus. A known drawback to this design is that the metal plates may require machining with multiple, eccentric "penetrations," and the packing components must also be manufactured with corresponding penetrations. Each cable sealing penetration must be sized and positioned to fit the outerjacket of the ESP cable, and must additionally precisely align with respect to one another. These numerous parts with eccentric penetrations may be relatively expensive to manufacture, due to the necessity for substantially exact alignment of the various eccentric penetrations with respect to the adjacent parts. These wellhead configurations may also be typically over-designed from both a pressure rating and cost standpoint for coal-bed methane gas producing wells or other low pressure oil or gas wells.

The wellhead assembly illustrated in FIG. 2 may be typically used on oil or gas wells presenting relatively high pressure in the wellbore annulus between the casing and tubing. Typically these well head configurations may have a pressure rating in the 3000 to 5000 psia range. At such pressures, corrosive, toxic and/or explosive gas can penetrate the armor or insulation of the ESP power cable, from within the wellbore, and may migrate to the surface and into the electrical control box creating a serious safety hazard. A means of physically truncating the power cable while permitting the passage of electricity may be required in these applications. This may be accomplished with costly and relatively complex additional hardware added to the wellhead, such as a double-ended plug or receptacle, commonly referred to as a "penetrator" or mandrel. The power feed-through penetrator may be positioned in the wellhead and may include upper and lower detachable power connectors and an insulating and sealing dielectric material to create a pressure barrier while allowing electricity to be conducted through the wellhead. These additional components may cost many times more than the wellhead body and tubing hanger, thus precluding their applicability for use with coal-bed methane wells, from a economic standpoint.

SUMMARY OF THE INVENTION

This invention provides a cost effective, improved reliability wellhead for effectively sealing between a tubing hanger and an electrical cable for powering a downhole ESP. This invention may be particularly applicable to low pressure and/or marginally economically wells where cost considerations are of relatively increased concern. A tubing hanger is provided which includes a tubing port for passing produced fluid therethrough, and a cable port for positioning the electrical power cable for the ESP therethrough. All sealing between the tubing hanger and the cable may be substantially performed within the cable port, as opposed to above the cable port. Thereby, smaller, less costly, more precisely sized and easier to manufacture and install cable sealing components may be utilized.

Laboratory testing of embodiments of this invention, such as illustrated in FIGS. 3, 4, 5, 6 and 7, has demonstrated a wellhead capable of effecting a pneumatic, vapor tight seal around an ESP power cable, at differential pressures across the seal of at least 750 psia for a 24 hour period. Such testing has been performed using nitrogen gas, which exhibited no leakage around the outer cable jacket, where the cable exits the top of the wellhead. Alternative embodiment versions of wellheads according to this invention may provide sealing capabilities of at least 1500 psig.

It is an object of the present invention to provide a wellhead for use with an ESP, in a relatively low pressure well. This invention provides a wellhead that may be used with wellbore pressures of at least 500 psig.

It is an additional object of this invention to provide a wellhead for sealing with an electrical cable for powering an ESP in the wellbore, wherein the power cable may extend from the motor to a power source external to the wellbore, such as in a control panel.

According to the present invention it is an additional object to provide a tubing hanger supported within a wellhead body on an upper end of a wellbore, wherein the tubing hanger includes at least a tubing port and a cable port therein. A tubing string connected on a lower end to the pump may be connected on an upper end to the tubing hanger in fluid communication with the tubing port. The flexible power cable may be positioned through the tubing hanger cable port. A cable seal may be provided within the cable port to seal between the power cable and the tubing hanger. A packing gland may be included to compress the cable seal.

It is an object of this invention to provide a method of sealing the interior of a wellhead providing a cable port in a tubing hanger supported within the wellhead, wherein a flexible ESP power cable is positioned within the cable port. The method may include positioning a cable seal within the cable port to seal between the power cable and the tubing hanger. A packing gland may be moved with respect to the tubing hanger to compress and activate the cable seal.

It is a feature of the present invention that upper and/or lower compression rings may be provided within the cable port to assist in compression of the cable seal.

It is also a feature of the present invention that the packing gland and the tubing hanger may threadably engage on another to facilitate turning the packing gland to compress the cable seal.

It is still another feature of the present invention that a plurality of bolts and corresponding bolt holes in the tubing hanger may be included to compress the cable seal as the bolts are tightened. Compressive forces may be transferred from the bolts to the packing gland by an upper portion of the packing gland and/or by a packing gland retainer engaged with each of the bolts and the packing gland.

It is a feature of the present invention that the tubing hanger and cable sealing components are relatively simple and cost effective to manufacture.

It is also a feature of this invention that the sealing capabilities of this invention are reliable and simple to install and maintain.

It is an additional feature of this invention that the methods and components of this invention may be retrofitted in existing wellheads and ESP installations.

Another feature of this invention is that it may be adapted to virtually any known ESP cable configuration, including multiple conductor, armored, round and flat cables.

It is an advantage of this invention is that the packing elements and the packing gland are smaller that prior art packing elements and glands. Adjustments may be effected with less effort and with improved sealing effectiveness as compared to prior art cable seals.

It is also a feature of this invention that the packing elements seal across less cross-sectional area and against less, lateral sealing surface area than prior art wellhead packoff seals for ESP installations.

It is an additional feature of this invention that the cable seal may be compressed by a variety of gland configurations. For example, in one embodiment, a packing gland may be threadably engaged within a portion of the cable port. In another embodiment, a packing gland may be threadably engaged to a portion of the tubing hanger other than in the cable port.

It is still another feature of this invention that a wellhead retainer cap is not required to effect a pneumatic seal with the cable and the tubing hanger in the cable port.

An additional feature of this invention is that a wellhead penetrator is not required, and an electrical power cable need not be segmented or cut at or near the tubing hanger to pass electrical power through the cable port.

It is an advantage of this invention to provide a cost-effective wellhead for economically sensitive ESP completions.

These and further objects, features, and advantages of the present invention will become apparent from the following detailed description, wherein reference is made to figures in the accompanying drawings.

DESCRIPTION OF THE PREFERRED EMBODIMENTS

Figure 1:
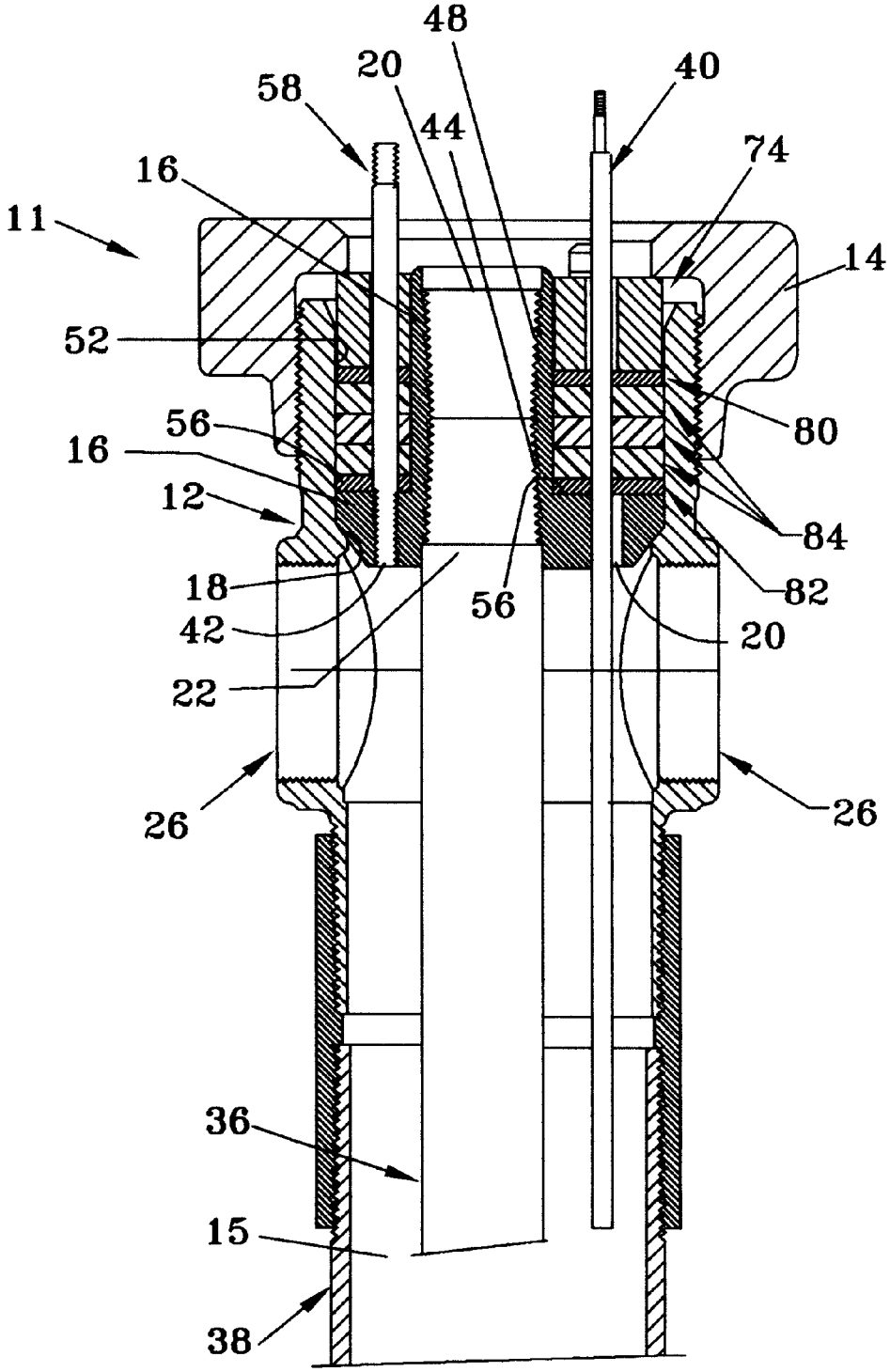
FIG. 1 PRIOR ART
FIG. 1 is a detailed cross-sectional view of a typical prior art wellhead for a relatively low pressure electrical submersible pump (ESP) installation.
Figure 2:
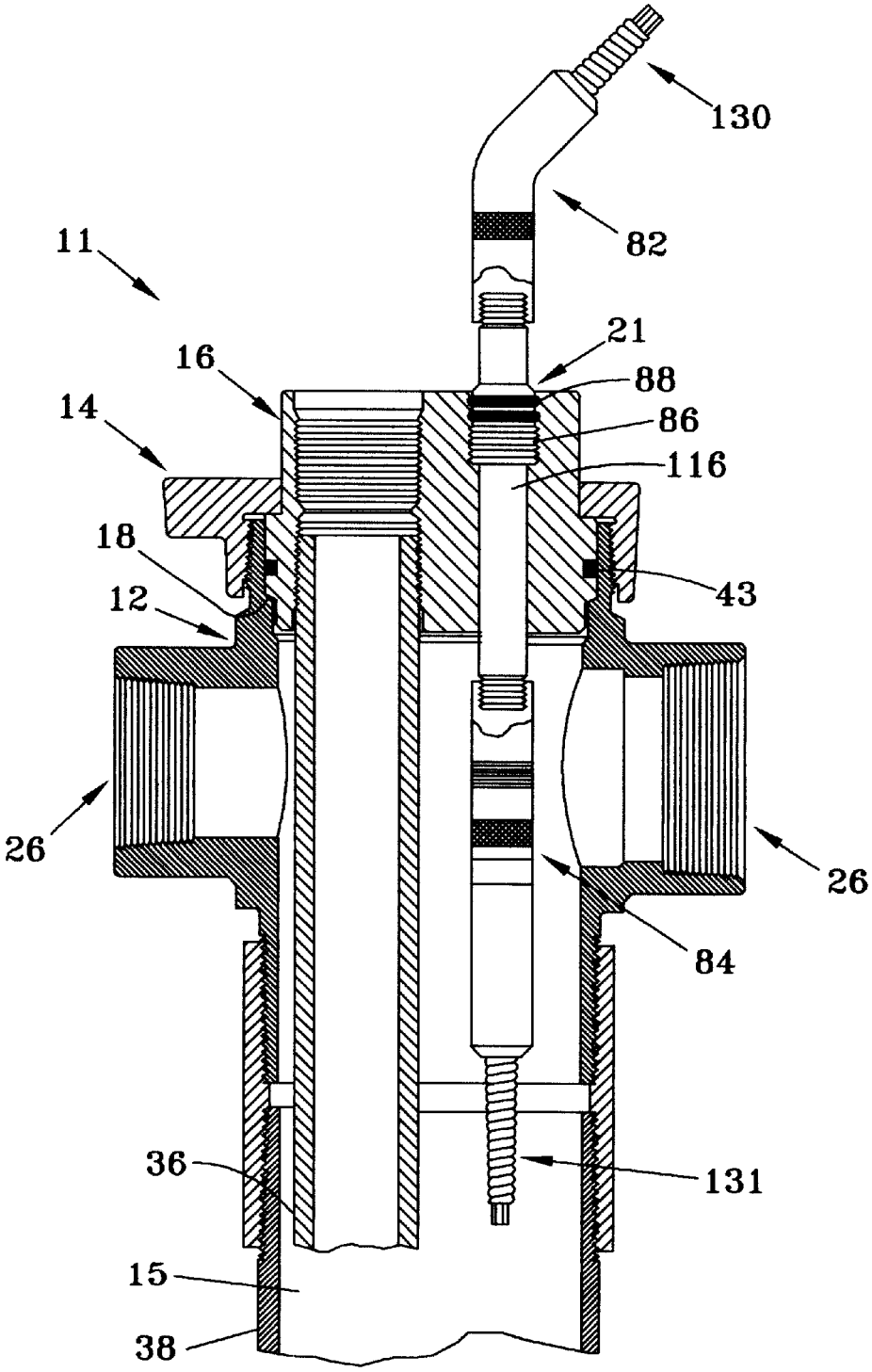
FIG. 2 is a cross-sectional view of a typical prior art ESP installation as typically utilized in relatively higher pressures, including a wellhead penetrator having cable connectors above and below the penetrator.

FIGS. 1 and 2 illustrate prior art wellheads 11 for an electrical submersible pump ("ESP") well pumping installation. The wellhead includes a wellhead body 12 fixedly or removably secured to an upper end of a well casing tubular 38. A well head body 12 may be secured to a casing tubular 38 by welding, clamping, or with bolts and flanges. The wellhead body 12 may also include side ports 26 to access to an interior portion of the well bore 15. An upper portion of the wellhead body may support a tubing hanger 16 at least partially positioned within the wellhead body 12. Typically, the wellhead body may include a tubing hanger shoulder 18 to support the tubing hanger 16 thereon. A retainer cap 14 may be provided to secure the tubing hanger 16 within the wellhead body 12.

Prior art tubing hanger for ESP installations may include a pair of adjacent, substantially parallel ports. A tubing port 22 may provide a through bore for the passage of fluid from the ESP, and may support or suspend a string of tubulars 36 positioned within the wellbore 15, connecting the wellhead 11 with a pump portion of the ESP. The term "fluid" as used herein may be defined broadly to include liquids and gases.

A lower portion of the tubing hanger 16 may include lower internal threads 44 within the tubing hanger port 22 for securing the tubing hanger 16 with the tubing 36. An upper portion of the tubing hanger may include an upper set of threads 48 within the tubing hanger port 22 for securing the tubing hanger 16 to additional production tubing or equipment, on the surface. Thereby, produced well fluid may be pumped from within the wellbore 15, through the pump, through production tubing 36, through the tubing port 22, and then to other surface production handling tubulars and equipment.

The tubing hanger 16 may also include a power cable port 20, through which to position a flexible electrical power cable 40 that passes electric power from an electric power source, through the tubing hanger port 24 and downhole to the electric motor on the ESP.

In one prior art embodiment as illustrated in FIG. 1, a pack-off assembly may be provided which simultaneously forms a pneumatic seal in the wellhead body for the tubing hanger and the flexible power cable 40. The pack-off assembly may include packing material 84, which may consist of multiple layers or packing elements, 84, and may include each of upper 80 and lower 82 packing compression rings. A packing gland 74 may engage the packing assembly 80, 82 and 84, to compress the packing material 84, to form the wellbore pneumatic seal in the wellhead body 12. In the prior art embodiment illustrated in FIG. 1, a retainer ring 14 may be threadably engaged with the wellhead body 12 to engage the packing gland 74, to compress the packing material 84.

The packing material 84 and compression rings 80, 82 are positioned around the cable 40 substantially outside of the cable port 20 in the tubing hanger. In addition, the packing assembly 80, 82, 84 and packing gland 74 may be positioned substantially above an upper surface 56 of the tubing hanger 16, and not within the power cable port 20. The packing gland 74 may include an outer diameter slightly smaller than an inner diameter of the wellhead body inner surface 52, such that the packing gland 74 may laterally engage surface 52. The tubing hanger 16 may include a cylindrical portion 54 projecting above surface 56 for providing the tubing port 22 therein. A portion of the cylindrical projection may be externally encompassed by the packing assembly 80, 82, 84.

One or more auxiliary ports 42 also may be provided in each of the tubing hanger 16, the pack-off assembly components 80, 82, 84, and the packing gland 84. A port nipple 58 may be included to provide surface access to the auxiliary port in the tubing hanger. The auxiliary port 42 may by used to inject chemical into the wellbore, such as corrosion inhibition chemical. The tubing hanger 16 may also include internal threads within the auxiliary port auxiliary port 42 to secure an additional tubular string within the wellbore 15 to the tubing hanger 16.

A common problem in ESP wellhead installations as illustrated in FIG. 1 is that multiple eccentric penetrations, ports or profiles may require manufacture within each of the multiple components 74, 80, 82, 84, and 16, such that during installation, each of the multiple components may properly line up each of the eccentric penetrations. In addition to potentially relatively expensive manufacturing costs, due to the relatively large size of the packing elements 84, relatively large compressive force may be required to properly effect a desired pneumatic seal. The compressed packing elements 84 may engage an inner wall 74 of the wellhead body 12.

FIG. 2 illustrates a prior art wellhead that may typically be used in higher pressure installations, including a wellhead penetrator 116. The tubing hanger 16 may include a penetrator port 21 for positioning the penetrator 116 through the power cable port. Threads 86 may secure the penetrator within the tubing hanger 16, and a penetrator seal member, such as O-rings 88, may provide a pneumatic seal between the penetrator 116 and the tubing hanger 16. A tubing hanger O-ring 46 may provide a pneumatic seal between the tubing hanger 16 and the well head body 12.

A flexible electric power cable 90, 91 does not pass through nor is it positioned within the penetrator port 21. Rather, the power cable 90, 91 may be comprised of at least two power cable segments joined by the penetrator 116. A first power cable segment 90 may extend from an electric power source to an upper end of the penetrator and be removably secured to the penetrator 80 by an upper cable connector 106. A second power cable segment 91 may extend from a lower end of the penetrator 116 to the electric motor downhole in the wellbore 15. An upper end of the lower power cable segment 91 may be removably secured to the lower end of the penetrator 116 by a lower cable connector 84. The penetrators are substantially rigid, non-flexible components including conductors inside of an insulating material. ESP wellhead installations including a penetrator 116 may be more costly than embodiments such as illustrated in FIG. 1, and wellhead embodiments according to this invention.

Figure 3:
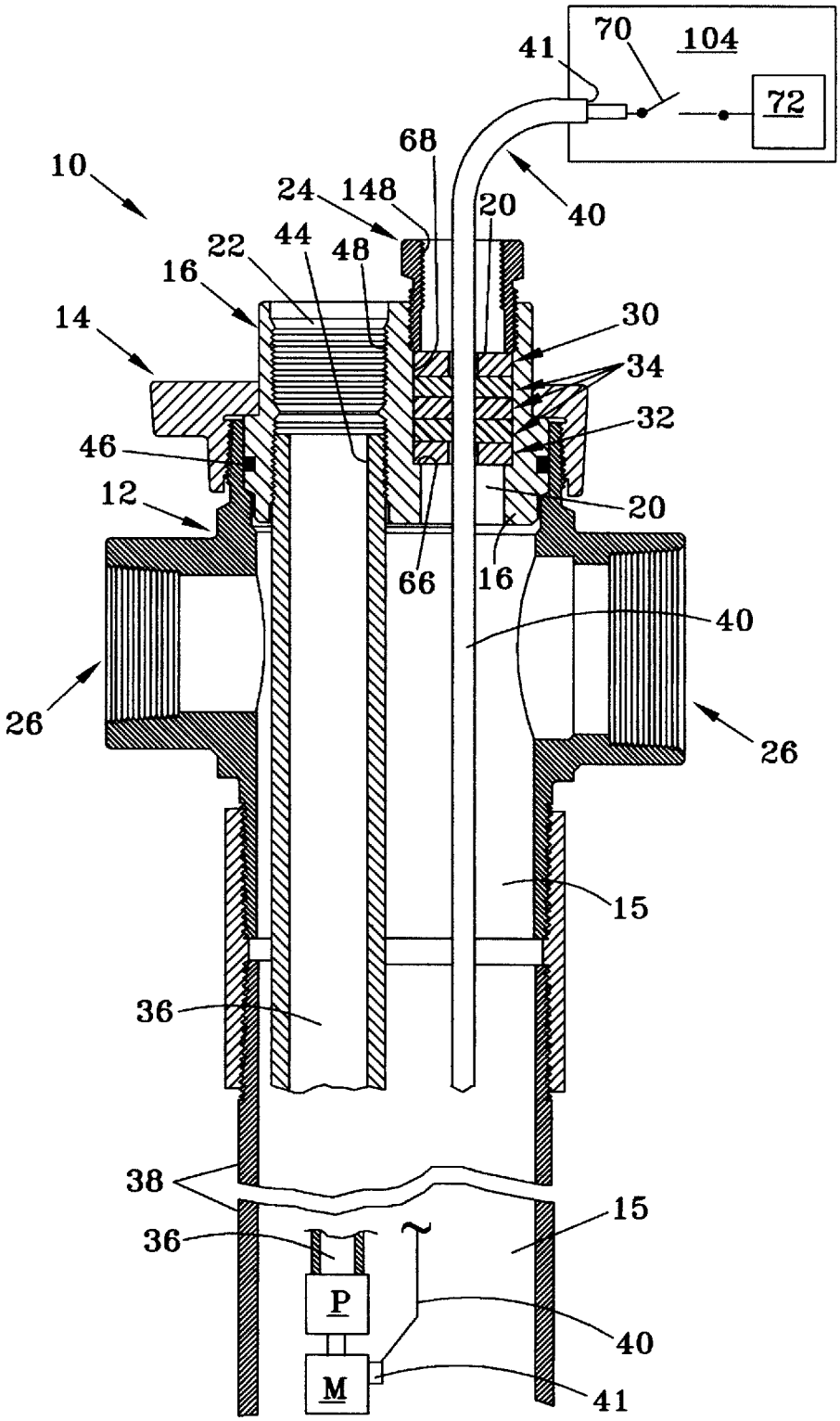
FIG. 3 is a cross-sectional illustration of a wellhead embodiment according to this invention.
Figure 4:
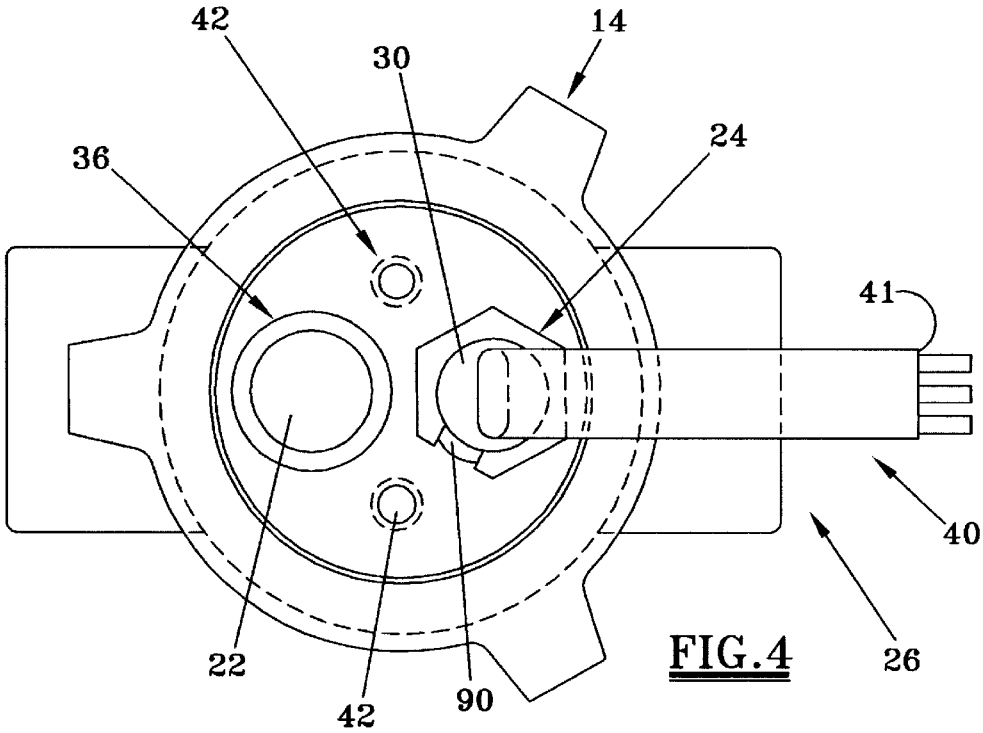
FIG. 4 is a top view illustration of a wellhead embodiment according to this invention.
Figure 6:
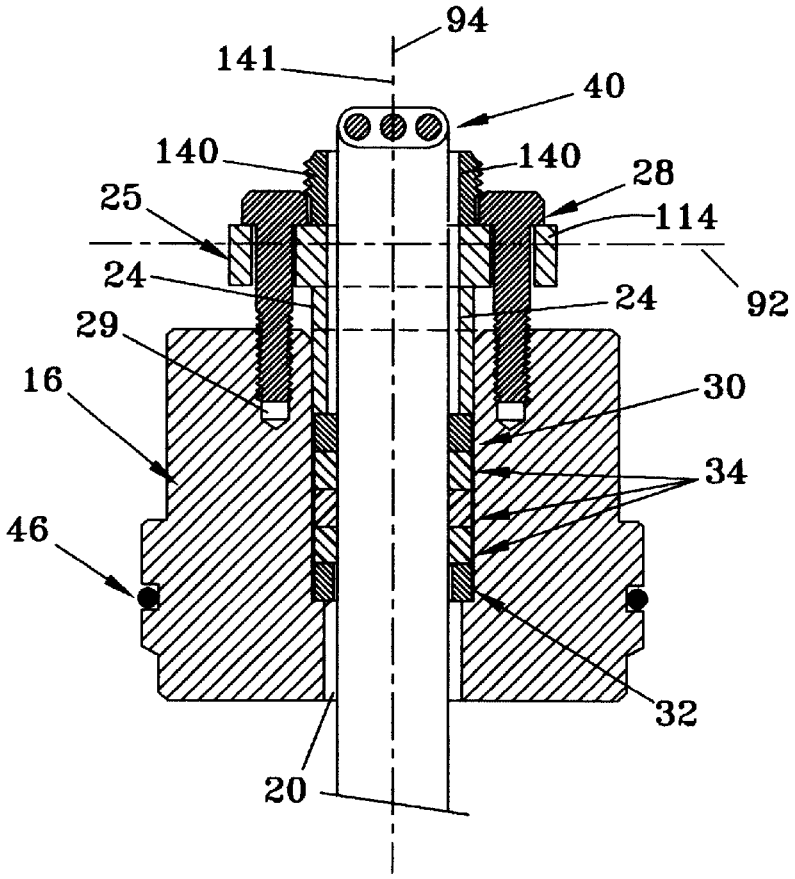
FIG. 6 is a cross-sectional view of a portion of the tubing hanger as may be used in the embodiment in FIG. 5.

FIGS. 3 and 4 illustrate an embodiment of a wellhead 10 according to the present invention for sealing with an electrical cable positioned through the wellhead, and may include a wellhead body 12, a retaining cap 14 and tubing hanger 16. The wellhead body 12 may support the tubing hanger at least partially therein. A support shoulder 18 in the wellhead body 12 may support the tubing hanger 16. The seal 46 as shown in FIGS. 2, 3, and 6 seals between the tubing hanger 16 and the wellhead body 12. The tubing hanger 16 may include at least two ports, a tubing port 22 and a power cable port 20, each eccentrically positioned in the tubing hanger with respect to the other. The ESP installation may include a downhole electric motor M connected to a downhole pump P which may be connected to a lower end of a tubular 36. The EXP installation may also include an electrical cable 40 for supplying electrical power between a power source and the electric motor. The cable 40 may be positioned through the tubing hanger 16 with a pneumatic seal in the tubing hanger between the cable 40 and the tubing hanger 16 to pack-off or seal an interior portion of the wellbore 15. All seals referred to are both pneumatic and hydraulic positive seals.

The tubing hanger 16 may include internal threads 44 within the tubing port 22 for removably securing the tubing hanger 16 to an upper end of a tubular 36 suspended of supported within the wellbore 15. The tubing hanger 16 may include internal threads 48 in an upper portion of the tubing port 22 for securing a surface tubular (not shown) to the tubing hanger 16. Thereby, fluid pumped from the ESP may be conducted through the tubing port 22.

The tubing hanger 16 may include a power cable port 20 having a cable axis. A power cable 40 may be positioned within the power cable port 20, substantially along the cable axis. The power cable 40 may be an elongated, substantially flexible electric cable having substantially uniform outer dimensions along its length, and having two ends, a motor end and a power source end. The motor end of the cable 40 may be removably secured to a motor on ESP, downhole in the wellbore 15. The power source end of the cable 40 may be removably secured to an on-off switch 70, an electrical disconnect, a circuit breaker, a relay, electrical lugs, or another device for controlling the flow of electrical power to the motor. The power source end of the cable 40 may terminate within a control panel box 104. An electrical power source 72 may be provided within the panel 74, in order to provide electrical power to the power cable.

The power cable 40 may be of any type as known in the industry, such as "round" cable or "flat" cable, and may include single or multiple conductors encased in one or more layers of insulation, and may be flexible. The flexible power cable may be defined as comprising an outer sheath having substantially uniform outer dimensions, and an inner electrical conductor extending from a motor end to a power source end, the motor end electrically connected to an electrical connector on the motor, and the power source end electrically connected to an electrical power source.

The power cable may also include an armor sheathing 41 or protective outer layer. The outer surface of the armor 41 may include surface features such as ridges or crevasses, which may effect cable flexibility. Although the cable 40 may be relatively stiff, it will be understood by those skilled in the art that the power cable is none-the-less substantially flexible, in that the cable may be spooled or coiled.

It will be understood by those skilled in that art that in practice the power cable 40 may include multiple segments in order to achieve the desired length or to effect repairs to the cable. In this invention the power cable 40 does not necessarily terminate or include a segment or cable connection within or substantially adjacent the tubing hanger 16, as may be required with prior art embodiments such as illustrated in FIG. 2. In this invention, the power cable 40 may be a single length segment between electrical connections 43 on the motor M and the control panel 74 without cable interconnections there-between.

A cable seal 34 may be provided within the cable port 20 for pneumatically sealing an annulus between the OD of the power cable 40 and a seal surface 68 in the ID of the power cable port 20. A cable seal 34 may include packing material, packing rings, packing compounds or other packing, sealing or pack-off components known in the industry. The cable seal 34 may include a throughbore therein to position the cable 40 through the throughbore and the cable seal 34 substantially around an external surface of the cable 40. The seal surface 68 may be a substantially cylindrical wall. The cable seal 34 may be a single packing element or multiple layers of sealing elements. The tubing hanger 16 may also include a lower packing seat 66 for supporting the cable seal thereon. Upper 30 and/or lower 32 compression rings may also be included with the cable seal to assist compressing or energizing the sealing elements 34 of the cable seal. The upper 30 and/or lower 32 compression rings each may include a through bore for positioning or passing the cable 40 therethrough. The lower compression ring 32 may be positioned between the cable seal and the packing seat 66.

Compression rings 30, 32, cable seals 34, a packing gland 24, and/or packing material 34 may include circumferential cut-out portions 90 or radial splits to facilitate ease of installation of these components around a cable 40. The compression rings 30, 32, cable seals 34 and/or packing materials 34 may be substantially sleeve or ring shaped, without a cutout or split, such that each ring shaped component may require sliding the component lengthwise over a portion of the cable to facilitate installation of the cable seal.

An embodiment of this invention, such as illustrated in FIG. 3, may typically include three packing rings 34, each of which may be about one-half inch thick, for a total stack height of one and one-half inches. Other embodiments may include more or less than three rings may be used such that the resulting stack height may be more or less than one and one-half inches.

A packing gland 24 selectively moveable with respect to the lower seat 66 may also be included for compressing the cable seal 34 to form a pneumatic seal between the cable 40 and the tubing port 20. The packing gland may be at least partially positioned within a portion of the cable port 20. The tubing hanger 16 and the packing gland 24 each may include threads to secure the packing gland 24 to the tubing hanger 16, and to threadably move the packing gland to compress the cable seal 34. An upper portion of the packing gland 24 may include wrench flats thereon. The packing gland 24 may exert downward mechanical pressure on the upper compression ring, which may in turn compress packing rings 34 or other packing material in sealing engagement around an outer periphery of the ESP power cable 40. The upper compression ring 30 may be positioned within the power cable port 20, and may include a throughbore for positioning the electrical power cable therethrough. The upper compression ring 30 may be positioned between the cable seal 34 and the packing gland 24 for transferring a compressive mechanical force from the packing gland 24 to the cable seal 34.

An embodiment of the invention as illustrated in FIGS. 3 and 4 may also include one or more auxiliary ports 42, such as may provide access to the interior of a wellbore from external to the wellbore, such as for chemical injection, capillary tubes, electrical conductors, instrumentation, and/ or as additional tubing ports 22 for multiple-zone well completions. The tubing hanger 16 may include female threads in each of the auxiliary ports 42 to reduce need for additional sealing materials within the auxiliary ports 42. An auxiliary port may typically be between ¼ inch and one inch, in OD. In some well completions, an auxiliary port 42 may facilitate connection of a second or parallel tubing string to the tubing hanger, such as in a "dual-completion." In such instance, an auxiliary port 42 in the tubing hanger 16 may be of a larger ID, and may include threads, such that the tubing hanger may include two tubing ports 22. A first tubing port 22 may be of a different size than the second tubing port 22 or 42. Auxiliary ports may be used for the conduct of fluids and/or electricity.

Figure 5:
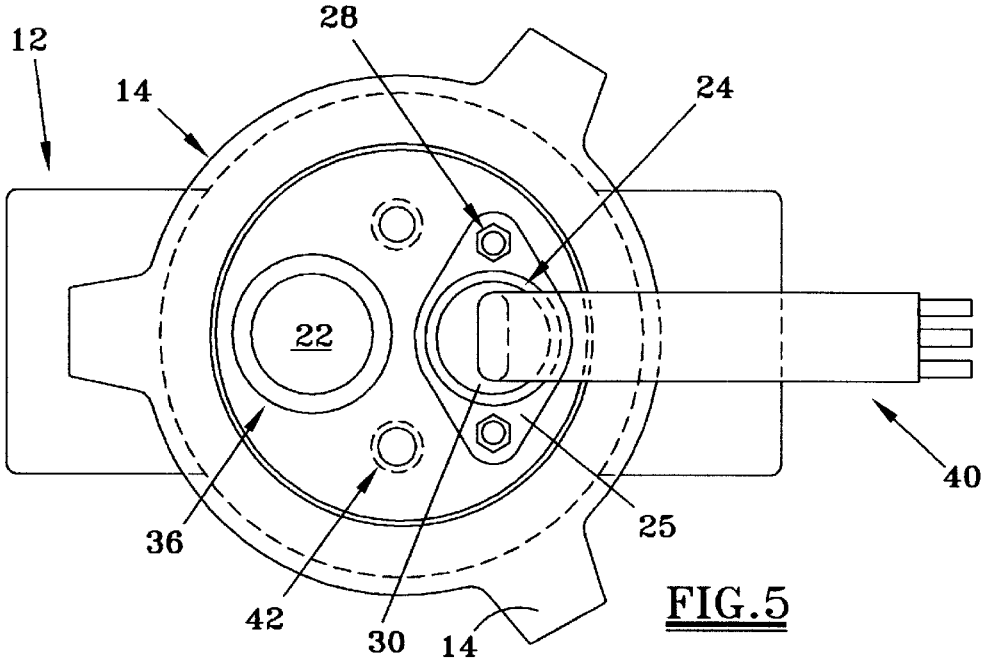
FIG. 5 is a top view of another wellhead embodiment according to this invention, including a packing gland retainer and an arrangement of two bolts for mechanically tightening the cable seal around the power cable.

FIGS. 5 and 6 illustrate an embodiment of the present invention wherein the packing gland 24 includes a substantially sleeve-shaped cylinder or bushing moveably positioned at least partially within the cable port 20. A plurality of gland retainer bolts 28 may be included for selectively moving the packing gland relative to the tubing hanger 16. Two or more retainer bolts 28 may be moveably secured to the tubing hanger 16, and may be substantially circumferentially positioned around the cable port 20. A plurality of retainer bolt-holes 29 may be provided in the tubing hanger 16 for adjustably securing each of a corresponding retainer bolt 28. A gland retainer 25 may be included for transferring a compressive force from each of the plurality of gland retainer bolts 28, through the gland retainer 25 to the packing gland 24. The gland retainer may include a plate central plane 92 substantially perpendicular to the cable axis 94 of the cable port 20. Thereby, tightening each of the bolts 28 may selectively compress or activate the cable seal 34 or packing material. The gland retainer 25 preferably may be fixedly secured to the packing gland 24, such as by being integrally formed, or secured such as by welding forming a single component. The gland retainer and the packing gland otherwise may be two distinct components. The gland retainer and the packing gland preferably may be fabricated from a rigid metallic material.

The upper and lower compression rings 30, 32 may be manufactured from common metals, such as steel, brass, bronze or aluminum, or they may be manufactured from other fibrous or elastomeric materials such as plastics or nylon. The cable seals 34 or packing material 34 or packing rings 34 may be manufactured from any deformable, malleable and/or flexible material, such as rubber, nitryl, fiber materials, other elastomers, or soft polymers.

The reduced sizes of the cable seal 34 system of this invention may provide several advantages, including reduced effort and force to compress the packing. As the outside diameter of the packing material and the packing gland may be reduced from approximately 7.00 inches under the prior art FIG. 1, system to approximately 2.25 inches in an embodiment of this invention for a similarly sized wellhead body 12. In addition, this invention may require less mechanical effort to effectively compress the packing 34 around the cable 40, and may also create a more reliable seal. The packing material 34 of this invention may be less costly due to the smaller size and due to the fact that the packing assembly 24, 30, 32, 34 may only require a single, on-center penetration cut or formed in each component. This is in contrast to the prior art packing assembly illustrated in FIG. 1, which typically requires more than one eccentric penetration be provided or manufactured in each component, to accommodate each of the tubing hanger projection, cable port and auxiliary ports. The prior art compression gland 74 and packing rings 34 may require at least two and often as many as ten eccentric penetrations to be precisely located with respect to each other, resulting in increased complexity and misaligned installations. The wellhead components of this invention may permit on-center penetrations of components, without having to align multiple penetrations in multiple components. Thereby, the sealing components of this invention may be manufactured with close tolerances to effect improved sealing capabilities with each of specific ESP cable outer jacket dimensions.

This invention also provides a method of sealing the interior of a wellhead 10 at the upper end of a wellbore 15 containing a downhole ESP P. The pump P may be powered by a flexible elongate electrical power cable 40 providing electrical power to the electrical submersible pump motor M. The power cable 40 may have uniform outer dimensions extending from a motor end to a power source end. The motor end may be electrically connected to an electrical connector on the motor, and the power source end electrically connected to an electrical power source 72 external to the wellbore.

The method may comprise supporting a wellhead body 12 on a well casing 38 and supporting a tubing hanger 16 within at least a portion of the wellhead body. The tubing hanger may include a tubing port 22 and a cable port 20 therein. The cable port 20 may contain a lower packing seat 66. The tubing hanger 16 may be sealingly connected with a tubular member 36 at least partially positioned within the wellbore 15, for passing fluid from the submersible pump through the tubing port 22. The power cable 40 may be positioning through the cable port 20, and may extend from the motor M to the power source 72 external to the wellbore, such as a control panel 74.

A cable seal 34 may be positioned at least partially within the tubing hanger cable port to seal between the power cable and the tubing hanger. A packing gland 24 may be selectively moved with respect to the tubing hanger 16 to selectively compress the cable seal 34 to form a pneumatic seal in the cable port 20 between the power cable 40 and the tubing hanger 16.

As illustrated in FIGS. 5 and 6, a plurality of packing gland retainer bolts 28 may be selectively threaded to the tubing hanger 16 to selectively compress the cable seal 34 in the cable port 20 to pneumatically seal between the power cable 40 and the tubing hanger 16. A packing gland retainer 25 may be provided to engage each of the bolts 28 and the packing gland 24 to transfer mechanical forces from the bolts 28 to the packing gland 24.

An upper compression ring 30, and/or a lower compression ring, 32, may be provided within the power cable port. Each compression ring 30, 32 may include a throughbore for passing the electrical power cable 40 therethrough. The upper ring 30 may be positioned between the cable seal 34 and the packing gland 24 for transferring a compressive force from the packing gland to the cable seal.

The methods for sealing the interior of a wellbore 15 according to this invention may effect a pneumatic seal, which provides a working or operating differential pressure of at least 500 psig. More particularly, the methods of this invention may effect a pneumatic seal that is operable at a differential pressure of at least 750 psig.

Alternative embodiments for the cable seal of this invention may include a cable seal 34 which consists of only one packing ring. The packing ring may range in height from approximately three-fourths of an inch thick to in excess of four inches thick. Embodiments of this invention may provide particular surface shapes on adjacent surfaces of the compression rings and/or the packing rings, as opposed to providing flat adjacent surfaces as illustrated in FIG. 3. For example, each packing ring 34 may include a chevron type shape on one or both sides of the rings and/or packing.

Cable seal components alternatively may be formed into two substantially equal halves, or each component may be a substantially single component including a split, cutout or circumferentially removed section to allow lateral positioning of the component around the power cable, thereby avoiding snaking the cable through the penetrations in the components. Similarly, as illustrated in FIG. 4, a packing gland may include a circumferential cutout section 90 removed to allow the packing gland to be laterally installed around the power cable without snaking the gland over the length of the cable.

Other embodiments of a wellhead according to this invention may provide an auxiliary port 142 through the cable packing 34, compression rings 30, 32, and packing gland 24. The auxiliary port 142 may be a separate through passageway from the cable through passageway in the sealing members, 24, 30, 32, 34. For example, such port 142 may be ¼" port for positioning an instrument, tube, or electrical conductor therethrough, to provide fluid communication and/or electrical communication between an interior of the wellbore and an external to the wellbore, through the auxiliary port. Such embodiment may also reduce the number of or eliminate auxiliary ports within the body of the tubing hanger 16.

Alternative embodiments of the present invention may provide an additional set of internal or external threads 148, or clamp profile on an end of the packing gland opposite the end of the packing gland engaging the cable seal 34. Such threads may provide for removably securing electrical conduit to the packing gland to protect the cable between the power source and the tubing hanger. A tubing hanger may also provide a conduit connector 140 having a conduit connector axis 141 positioned along the cable port axis 94, such as a sleeve shaped nipple fixedly secured thereto, or to a packing gland retainer 25, as illustrated in FIG. 6, to connect electrical conduit to the tubing hanger 16 and/or the retainer 25.

An alternative embodiment of this invention may include a tubing hanger providing a slip bowl with a portion of the tubing port. A plurality of slip segments may be included and positioned within the tubing port, between a tubular member positioned in through the tubing port and the slip bowl portion of the tubing port. Thereby, the slip segments may grip the tubular member to support the tubular at least partially within and partially without of the wellbore. In such embodiment, the cable port may be included in the tubing hanger, substantially adjacent and parallel the tubing port.

Other alternative embodiments of a wellhead according to the present invention may eliminate the retainer cap 14. The tubing hanger 16 may be retained in place by the weight of the tubing string 36 suspended therefrom. In other embodiments, the wellhead body may include bolt holes or clamp profiles, such that tubing hanger retainers may be secured to the wellhead body, such as by bolting or clamping thereon, and extend to engage a portion of the tubing hanger to secure the tubing hanger within the wellhead body.

We claim:

1. A wellhead for sealing with a continuous electrical power cable for powering a downhole electrical submersible pump including an electrical motor within a well bore, the electrical power cable passing without interruption through the wellhead for electrically connecting the motor with an electrical power source external of the wellhead, the wellhead comprising:

a wellhead body for supporting a tubing hanger at least partially therein; the tubing hanger including a tubing port for conducting a fluid from the submersible pump through the tubing port, and a power cable port having a cable axis for passing electrical power from the electrical power source through the power cable port to the electric motor;

a cable seal within an annulus between the outer diameter of the power cable and an inner diameter of the power cable port for pneumatically sealing between the power cable and the wellhead body;

a lower packing seat for supporting the cable seal; and a packing gland selectively moveable with respect to the seat for compressing the cable seal to form a pneumatic seal.

2. The wellhead as described in claim 1, further comprising:

an upper compression ring within the power cable port, the upper compression ring including a throughbore for passing the electrical power cable therethrough, and positioned between the cable seal and the packing gland for transferring a compressive force from the packing gland to the cable seal.

3. The wellhead as described in claim 1, further comprising:

a retainer cap to secure the tubing hanger within the wellhead body.

4. The wellhead as described in claim 1, wherein the power cable port has a substantially cylindrical wall for engagement with the cable seal.

5. The wellhead as described in claim 1, wherein the packing gland includes external threads for selectively securing the packing gland to the tubing hanger.

6. The wellhead as described in claim 1, wherein the packing gland further comprises:

a gland retainer adjustably secured to the tubing hanger by a plurality of retainer bolts, the gland retainer to engage the packing gland and selectively cause the packing gland to move relative to the tubing hanger to compress the cable seal.

7. The wellhead as described in claim 6, wherein the packing gland is fixedly secured to the gland retainer.

8. The wellhead as described in claim 1, wherein the tubing hanger further includes at least one auxiliary port for accessing an interior portion of the wellbore for at least one of fluid communication and electrical communication therethrough.

9. The wellhead as described in claim 1, wherein the tubing hanger includes internal threads surrounding the tubing port to sealingly secure a threaded tubular member positioned within at least a portion of the wellbore to the tubing hanger.

10. The wellhead as described in claim 1, wherein the packing gland is substantially sleeve shaped.

11. The wellhead as described in claim 1, wherein the packing gland is substantially sleeve shaped with at least one cutout portion for laterally positioning the packing gland around the power cable.

12. The wellhead as described in claim 1, wherein the packing gland includes a conduit connector for removably securing an electrical conduit to the packing gland.

13. The wellhead as described in claim 1, wherein the tubing hanger further includes a conduit connector for removably securing an electrical conduit to the tubing hanger.

14. A well head for sealing with an electrical power cable for powering a downhole electrical submersible pump including an electrical motor within a well bore, the power cable passing without interruption through the wellhead for electrically connecting the motor with an electrical power source the wellhead comprising:

a wellhead body including casing threads for securing the wellhead body to a threaded wellbore casing;

one or more side ports in the wellhead body for accessing an interior portion of the wellbore;

a tubing hanger supported at least partially within the wellhead body and including a tubing port for conducting a fluid from the submersible pump through the tubing port, and a power cable port having a cable axis for passing electrical power from the electrical power source, then through the power cable port and to the electric motor;

a tubing hanger seal for pneumatically sealing the annulus between the tubing hanger and the wellhead body;

a retainer cap for securing the tubing hanger to the wellhead body;

a packing material within the power cable port for pneumatically sealing an annulus between an outer diameter of the power cable and an inner diameter of the power cable port;

a lower packing seat for supporting the packing material at least partially within the tubing hanger;

a packing gland selectively moveable with respect to the tubing hanger for compressing the packing material to form a pneumatic seal;

a plurality of rotatable gland retainer securing members moveably engaged with the tubing hanger for selectively moving the packing gland relative to the tubing hanger; and a gland retainer engaged with each of the plurality of gland retainer securing members and with the packing gland for transferring a compressive force from each of the plurality of gland retainer securing members to the packing gland.

15. The wellhead as defined in claim 14, further comprising:

the gland retainer including a metal plate having a plate central plane substantially perpendicular to the axis of the power cable port, the metal plate engaging each of the plurality of securing members and the packing gland.

16. The wellhead as described in claim 15, wherein the metal plate is fixedly secured to the packing gland.

17. The wellhead as described in claim 14, wherein the power cable further comprises:

an outer sheath having substantially uniform outer dimensions, and an inner electrical conductor extending from a motor end to a power source end, the motor end electrically connected to an electrical connector on the motor, and the power source end electrically connected to the electrical power source.

18. The wellhead as described in claim 14, wherein the tubing hanger further comprises:

at least one auxiliary port to access an interior portion of the wellbore for at least one of fluid communication and electrical communication therethrough.

19. A method of sealing the interior of a wellhead at the upper end of a wellbore containing a downhole electrical submersible pump, the pump being powered by a flexible elongate electrical power cable providing electrical power to the electrical submersible pump motor, the power cable having uniform outer dimensions extending from a motor end to a power source end, the motor end electrically connected to an electrical connector on the motor, and the power source end electrically connected to an electrical power source external to the wellbore, the method comprising:

supporting a wellhead body on a well casing;

supporting a tubing hanger within at least a portion of the wellhead body, the tubing hanger including a tubing port and a cable port therein, the cable port containing a lower packing seat;

sealingly connecting the tubing hanger with a tubular member at least partially positioned within the wellbore for passing fluid from the submersible pump through the tubing port;

positioning the power cable through the cable port;

positioning a cable seal at least partially within the tubing hanger cable port to seal between the power cable and the tubing hanger;

selectively moving a packing gland with respect to the tubing hanger to selectively compress the cable seal to form a pneumatic seal in the cable port between the power cable and the tubing hanger.

20. The method as described in claim 19, further comprising:

selectively threading a plurality of packing gland retainer bolts to the tubing hanger to selectively compress the cable seal in the cable port to pneumatically seal between the power cable and the tubing hanger.

21. The method as described in claim 19, further comprising:

providing an upper compression ring within the power cable port, the upper compression ring including a throughbore for passing the electrical power cable therethrough, and positioned between the cable seal and the packing gland for transferring a compressive force from the packing gland to the cable seal.

22. The method as described in claim 19, wherein the pneumatic seal may operate at a differential pressure of at least 500 psig.

23. The method as described in claim 19, wherein the pneumatic seal may operate at a differential pressure of at least 750 psig.

24. The method as described in claim 19, further comprising:

providing the power cable port with a substantially cylindrical wall for engagement with the cable seal.

25. The method as described in claim 19, further comprising:

providing external threads on the packing gland for selectively securing the packing gland to the tubing hanger.

26. The method as described in claim 19, further comprising:

securing the gland retainer to the tubing hanger by a plurality of retainer bolts, the gland retainer engaging the packing gland to move relative to the tubing hanger to compress the cable seal.

27. The method as described in claim 26, wherein the packing gland is fixedly secured to the gland retainer.

28. The method as described in claim 19, further comprising:

providing at least one auxiliary port in the tubing hanger for accessing an interior portion of the wellbore for at least one of fluid communication and electrical communication therethrough.

29. The method as described in claim 19, further comprising:

providing internal threads surrounding the tubing port to sealingly secure a threaded tubular member positioned within at least a portion of the wellbore to the tubing hanger.

30. The method as described in claim 19, further comprising providing a sleeve-shaped packing gland with at least one cutout portion for laterally positioning the packing gland around the power cable.

31. The method as described in claim 19, further comprising:

providing a conduit connector on the packing gland for removably securing an electrical conduit to the packing gland.

32. The method as described in claim 19, further comprising:

providing a conduit connector on the tubing hanger for removably securing an electrical conduit to the tubing hanger.

33. A wellhead for sealing with a continuous electrical power cable for powering a downhole electrical submersible pump including an electrical motor within a well bore, the electrical power cable passing without interruption through the wellhead for electrically connecting the motor with an electrical power source external of the wellhead, the wellhead comprising:

a wellhead body for supporting a tubing hanger at least partially therein;

the tubing hanger including a tubing port for conducting a fluid from the submersible pump through the tubing port, and a power cable port having a cable axis for passing electrical power from the electrical power source through the power cable port to the electric motor;

a cable seal sealing an annulus between the outer diameter of the power cable and an inner diameter of the power cable port;

a lower packing seat for supporting the cable seal;

a packing gland selectively moveable with respect to the seat for compressing the cable seal; and a gland retainer fixably secured to the packing gland and adjustably secured to the tubing hanger by a plurality of rotatable securing members, the gland retainer engaging the packing gland to move the packing gland relative to the tubing hanger to compress the cable seal.

34. The wellhead as described in claim 33, further comprising:

an upper compression ring within the power cable port, the upper compression ring including a throughbore for passing the electrical power cable therethrough, and positioned between the cable seal and the packing gland for transferring a compressive force from the packing gland to the cable seal.

35. The wellhead as described in claim 33, further comprising:

a retainer cap to secure the tubing hanger within the wellhead body.

36. The wellhead as described in claim 33, wherein the power cable port has a substantially cylindrical wall for engagement with the cable seal.

37. The wellhead as described in claim 33, wherein the packing gland includes external threads for selectively securing the packing gland to the tubing hanger.

38. The wellhead as described in claim 33, wherein the tubing hanger further includes at least one auxiliary port for accessing an interior portion of the wellbore for at least one of fluid communication and electrical communication therethrough.

39. The wellhead as described in claim 33, wherein the tubing hanger includes internal threads surrounding the tubing port to sealingly secure a threaded tubular member positioned within at least a portion of the wellbore to the tubing hanger.

40. The wellhead as described in claim 33, wherein the packing gland is substantially sleeve shaped.

41. The wellhead as described in claim 33, wherein the packing gland is substantially sleeve shaped with at least one cutout portion for laterally positioning the packing gland around the power cable.

42. The wellhead as described in claim 33, wherein the packing gland includes a conduit connector for removably securing an electrical conduit to the packing gland.

43. The wellhead as described in claim 33, wherein the tubing hanger further includes a conduit connector for removably securing an electrical conduit to the tubing hanger.

44. A wellhead for sealing with a continuous electrical power cable for powering a downhole electrical submersible pump including an electrical motor within a well bore, the electrical power cable passing without interruption through the wellhead for electrically connecting the motor with an electrical power source external of the wellhead, the wellhead comprising:

a wellhead body for supporting a tubing hanger at least partially therein;

the tubing hanger including a tubing port for conducting a fluid from the submersible pump through the tubing port, and a power cable port having a cable axis for passing electrical power from the electrical power source through the power cable port to the electric motor;

a cable seal sealing an annulus between the outer diameter of the power cable and an inner diameter of the power cable port for pneumatically sealing between the power cable and the wellhead body;

a lower packing seat for supporting the cable seal;

a packing gland selectively moveable with respect to the seat for compressing the cable seal;

first and second retainer securing members on opposing sides of the cable port; and a gland retainer including a metal plate having a plate central plane substantially perpendicular to the axis of the port, the metal plate engaging each of the first and second securing members and the packing gland.

45. The wellhead as described in claim 44, further comprising:

an upper compression ring within the power cable port, the upper compression ring including a throughbore for passing the electrical power cable therethrough, and positioned between the cable seal and the packing gland for transferring a compressive force from the packing gland to the cable seal.

46. The wellhead as described in claim 44, further comprising:

a retainer cap to secure the tubing hanger within the wellhead body.

47. The wellhead as described in claim 44, wherein the power cable port has a substantially cylindrical wall for engagement with the cable seal.

48. The wellhead as described in claim 44, wherein the packing gland includes external threads for selectively securing the packing gland to the tubing hanger.

49. The wellhead as described in claim 44, wherein the tubing hanger further includes at least one auxiliary port for accessing an interior portion of the wellbore for at least one of fluid communication and electrical communication therethrough.

50. The wellhead as described in claim 44, wherein the tubing hanger includes internal threads surrounding the tubing port to sealingly secure a threaded tubular member positioned within at least a portion of the wellbore to the tubing hanger.

51. The wellhead as described in claim 44, wherein the packing gland is substantially sleeve-shaped.

52. The wellhead as described in claim 44, wherein the packing gland is substantially sleeve-shaped with at least one cutout portion for laterally positioning the packing gland around the power cable.

53. The wellhead as described in claim 44, wherein the packing gland includes a conduit connector for removably securing an electrical conduit to the packing gland.

54. The wellhead as described in claim 44, wherein the tubing hanger further includes a conduit connector for removably securing an electrical conduit to the tubing hanger.

55. A method of sealing the interior of a wellhead at the upper end of a wellbore containing a downhole electrical submersible pump, the pump being powered by a flexible elongate electrical power cable providing electrical power to the electrical submersible pump motor, the power cable having uniform outer dimensions extending from a motor end to a power source end, the motor end electrically connected to an electrical connector on the motor, and the power source end electrically connected to an electrical power source external to the wellbore, the method comprising:

supporting a wellhead body on a well casing;

supporting a tubing hanger including a tubing port and a cable port therein, the cable port containing a lower packing seat;

providing a cable seal to seal between the power cable and the tubing hanger;

sealingly connecting the tubing hanger with a tubular member at least partially positioned within the wellbore for passing fluid from the submersible pump through the tubing port;

positioning the power cable through the cable port and the cable seal;

selectively threading a plurality of packing gland retainer securing members to the tubing hanger to move a packing gland with respect to the tubing hanger to selectively compress the cable seal to form a pneumatic seal in the cable port between the power cable and the tubing hanger.

56. The wellhead as described in claim 55, wherein the tubing hanger further includes a conduit connector for removably securing an electrical conduit to the tubing hanger.

57. The method as described in claim 55, further comprising:

providing the power cable port with a substantially cylindrical wall for engagement with the cable seal.

58. The method as described in claim 55, further comprising:

providing external threads on the packing gland for selectively securing the packing gland to the tubing hanger.

59. The method as described in claim 58, further comprising:

securing the gland retainer to the tubing hanger by a plurality of retainer bolts, the gland retainer engaging the packing gland to move relative to the tubing hanger to compress the cable seal.

60. The method as described in claim 55, wherein the packing gland is fixedly secured to the gland retainer.

61. The method as described in claim 55, further comprising:

providing at least one auxiliary port in the tubing hanger for accessing an interior portion of the wellbore for at least one of fluid communication and electrical communication therethrough.

62. The method as described in claim 55, further comprising:

providing internal threads surrounding the tubing port to sealingly secure a threaded tubular member positioned within at least a portion of the wellbore to the tubing hanger.

63. The method as described in claim 55, further comprising providing a sleeve-shaped packing gland with at least one cutout portion for laterally positioning the packing gland around the power cable.

64. The method as described in claim 55, further comprising:

providing a conduit connector on the packing gland for removably securing an electrical conduit to the packing gland.

* * * * *